US009399914B2

(12) United States Patent
Roth et al.

(10) Patent No.: US 9,399,914 B2
(45) Date of Patent: Jul. 26, 2016

(54) TOOL HOLDER

(71) Applicants: Betek GmbH & Co. KG, Aichhalden (DE); Wirtgen GmbH, Windhagen (DE)

(72) Inventors: Markus Roth, Aichhalden (DE); Thomas Allgaier, Schramberg-Sulgen (DE); Thomas Lehnert, Oberraden (DE)

(73) Assignee: Wirtgen GmbH (CZ)

( * ) Notice: Subject to any disclaimer, the term of this patent is extended or adjusted under 35 U.S.C. 154(b) by 117 days.

(21) Appl. No.: 14/347,409

(22) PCT Filed: Oct. 11, 2012

(86) PCT No.: PCT/EP2012/070145
§ 371 (c)(1),
(2) Date: Aug. 20, 2014

(87) PCT Pub. No.: WO2013/053812
PCT Pub. Date: Apr. 18, 2013

(65) Prior Publication Data

US 2015/0345291 A1 Dec. 3, 2015

(30) Foreign Application Priority Data

Oct. 11, 2011 (DE) ..... 10 2011 054 384

(51) Int. Cl.
*E21C 35/19* (2006.01)
*E21C 35/197* (2006.01)
*E21C 35/18* (2006.01)

(52) U.S. Cl.
CPC ..... *E21C 35/197* (2013.01); *E21C 35/18* (2013.01); *E21C 35/19* (2013.01)

(58) Field of Classification Search
CPC ..... E21C 35/19; E21C 35/197
USPC ..... 299/106, 107, 110
See application file for complete search history.

(56) References Cited

U.S. PATENT DOCUMENTS 3,499,685 A * 3/1970 Kniff ..... E21C 35/197 299/104
3,830,546 A 8/1974 Kniff (Continued)

FOREIGN PATENT DOCUMENTS

CN 201474694 U 5/2010
DE 1923922 11/1970

(Continued)

OTHER PUBLICATIONS

International Search Report in corresponding International Application No. PCT/EP2012/070144, dated Feb. 6, 2014, 3 pp. (not prior art).

(Continued)

*Primary Examiner* — David Bagnell
*Assistant Examiner* — Michael Goodwin
(74) *Attorney, Agent, or Firm* — Lucian Wayne Beavers; Patterson Intellectual Property Law PC

(57) ABSTRACT

The invention relates to a bit holder for a road milling machine or the like, having a base part on which a bit shank and a projection are shaped, the projection comprising a bit receptacle, and the bit receptacle being constituted from a socket-shaped insert made of hard material. With a bit holder of this kind, good rotational behavior of the bit can be assisted and stable bracing thereof can be guaranteed, with little parts outlay, if provision is made that the bit receptacle is embodied as a stepped bore that comprises a first and a second diameter region, the first diameter region having a larger inside diameter than the second diameter region.

8 Claims, 7 Drawing Sheets

(56) References Cited

U.S. PATENT DOCUMENTS

| | | | | |
|---|---|---|---|---|
| 4,149,753 | A | 4/1979 | Stoltz et al. | |
| 4,327,947 | A | 5/1982 | Bower, Jr. | |
| 4,488,759 | A | 12/1984 | Bergqvist | |
| 4,575,156 | A * | 3/1986 | Hunter | E21C 35/197 299/107 |
| 4,632,463 | A | 12/1986 | Sterwerf, Jr. | |
| 4,678,238 | A | 7/1987 | Emmerich | |
| 5,415,462 | A * | 5/1995 | Massa | E21C 35/197 299/106 |
| 5,730,502 | A | 3/1998 | Montgomery, Jr. | |
| 6,099,081 | A * | 8/2000 | Warren | E21C 35/187 299/104 |
| 6,113,195 | A | 9/2000 | Mercier et al. | |
| 6,712,431 | B1 * | 3/2004 | Bosch | E21C 35/197 299/104 |
| 6,851,758 | B2 | 2/2005 | Beach | |
| 8,573,706 | B2 | 11/2013 | Parrott et al. | |
| 2004/0118615 | A1 | 6/2004 | Beach | |
| 2005/0146198 | A1 | 7/2005 | Hill et al. | |
| 2006/0125308 | A1 | 6/2006 | Sollami | |
| 2006/0186724 | A1 * | 8/2006 | Stehney | E21C 35/197 299/104 |
| 2007/0080575 | A1 * | 4/2007 | Sollami | E21C 35/197 299/106 |
| 2008/0030065 | A1 | 2/2008 | Frear | |
| 2010/0148568 | A1 | 6/2010 | Latham | |
| 2010/0244545 | A1 | 9/2010 | Hall et al. | |
| 2011/0175430 | A1 | 7/2011 | Heiderich et al. | |
| 2011/0193399 | A1 | 8/2011 | Monyak et al. | |
| 2011/0241407 | A1 * | 10/2011 | Fader | E21C 35/197 299/29 |
| 2012/0119563 | A1 * | 5/2012 | Parrott | E21C 35/197 299/81.3 |

FOREIGN PATENT DOCUMENTS

| | | | |
|---|---|---|---|
| DE | 2630276 | A1 | 1/1978 |
| DE | 3307895 | A1 | 9/1983 |
| DE | 9411438 | U1 | 11/1994 |
| DE | 19630642 | A1 | 2/1998 |
| DE | 10325253 | A1 | 12/2004 |
| DE | 102005001535 | B3 | 8/2006 |
| DE | 102009027732 | A1 | 1/2011 |
| EP | 0412287 | A2 | 2/1991 |
| FR | 2522578 | A1 | 9/1983 |
| WO | 2009003561 | A1 | 1/2009 |
| WO | 2013053813 | A2 | 4/2013 |

OTHER PUBLICATIONS

International Search Report in corresponding International Application No. PCT/EP2012/070146, dated Feb. 6, 2014, 3 pp. (not prior art).

International Search Report in corresponding International Application No. PCT/EP2012/070147, dated Feb. 6, 2014, 3 pp. (not prior art).

U.S. Appl. No. 14/347,405, filed Oct. 11, 2012 to Allgaier et al. (not prior art).

U.S. Appl. No. 14/347,410, filed Oct. 11, 2012 to Roth et al. (not prior art).

Office Action in co-pending U.S. Appl. No. 14/347,410 dated Feb. 13, 2015, 14 pp. (not prior art).

Office Action in co-pending U.S. Appl. No. 14/347,405 dated Apr. 7, 2015, 17 pp. (not prior art).

Office Action in co-pending U.S. Appl. No. 14/347,405 dated Jul. 22, 2015, 13 pp. (not prior art).

* cited by examiner

TOOL HOLDER

The invention relates to a bit holder for a road milling machine or the like, having a base part on which a bit shank and a projection are shaped, the projection comprising a bit receptacle, and the bit receptacle being constituted from a socket-shaped insert made of hard material.

A bit holder of this kind is known from DE 196 30 642 A1. A through bore that comprises a diameter-widening bore segment is incorporated into the bit holder. A socket-shaped insert made of hard metal is inserted into this bore segment. This insert forms a bit receptacle into which a round-shank bit can be inserted. The round-shank bit comprises a bit head and a bit shaft adjacent thereto. The bit shank carries a clamping sleeve that clamps with its outer periphery in the bit receptacle of the insert. The bit head is braced with respect to the insert via a wear protection disk. The clamping sleeve forms a rotary bearing system that retains the round-shank bit in an axial direction, but the latter remains freely rotatable around its longitudinal center axis. The round-shank bit rotates during operational use, and its bit head abrades along on the wear protection disk. Rotating wear is thereby produced. The wear protection disks are usually designed in such a way that they guarantee secure bracing of the bit head over the entire service life of the bit.

It is an object of the invention to create a bit holder for a road milling machine of the kind mentioned initially that, with little parts outlay, assists good rotational behavior of the bit and guarantees stable bracing thereof.

This object is achieved in that the bit receptacle is embodied as a stepped bore that comprises a first and a second diameter region, the first diameter region having a larger inside diameter than the second diameter region.

The two diameter regions form bearing segments that can be used to brace the shank bit. The first diameter region can directly receive a segment of the shank bit and can form a rotary bearing system therewith even without interposition of a wear protection sleeve. Parts outlay is thereby appreciably minimized. The second diameter region can likewise be used to brace the bit; it receives a second shank segment of the bit which then carries a simple securing element that is braced within the second diameter region. The result is to form a support length between the first and the second diameter region that guarantees tilt-stable bracing of the shank bit with little parts outlay. In addition, the diameter reduction also makes possible dimensionally optimized design of both the insert and the shank bit, contributing to a decrease in parts outlay. The stepped bore cross section moreover appreciably simplifies bit installation, even under austere construction site conditions and with restricted space.

According to a preferred configuration of the invention, provision can be made that the first diameter region forms an insertion opening for the bit to be installed. The first diameter region can transition into the insertion opening directly or via a taper segment, for example a conical introduction chamfer.

Particularly preferably, provision can be made that the first and the second diameter region lead into one another by means of a rounded or conical taper. On the one hand, this creates a stress-optimized transition. On the other hand, this taper offers the possibility of allowing a securing element to be slid on, and compressing it radially inward in order to impart to it a clamping effect that can be then be used to retain the shank bit. Bit installation can thereby be further simplified.

Especially for the sector of road milling applications, it has been found that a bit holder configuration in which the inside diameter of the first diameter region is selected to be between 16 mm and 24 mm is advantageous. This diameter range is dimensioned sufficiently for the prevailing loads, and in particular it can reliably receive, with no risk of material deformations, the transverse forces that act transversely to the longitudinal center axis of the shank bit and cause bearing stress.

For road applications of this kind it has also been found that the inside diameter of the second diameter region should be between 12 mm and 20 mm. Load-optimized discharge of the flexural forces in the bit shank is thereby ensured.

The diameter ratio between the diameter of the first diameter region and the diameter of the second diameter region is preferably selected in the range between 1.1 and 1.4, thereby taking into account excessive reductions in cross section and the accompanying risk of notch stress breakage.

According to a possible variant of the invention, provision can be made that the insert comprises an abutting surface, extending radially with respect to the longitudinal center axis of the insert, that proceeds annularly around the entrance opening of the first diameter region. The abutting surface can be used for direct abutment of the bit head of a shank bit, and interposition of a wear protection disk can also be omitted. The bit head then abrades directly on the insert during operational use. The desired faster wear of the shank bit with respect to the bit holder will then occur because the bit head is usually made of a softer material than the insert.

Particularly preferably, the insert comprises an abutment surface with which it is braced against a stop of the projection in such a way that the abutting surface transitions flush into an annular surface, adjacent to the abutting surface, of the projection. This annular surface can be arranged, in particular, radially with respect to the longitudinal center axis of the insert.

If provision is made that the bit receptacle is incorporated as a through bore into the insert and opens into a bore segment of the projection which forms a drive-out opening; and that the inside diameter of the second diameter region is smaller than the inside diameter of the bore segment, then on the one hand the insert of the shank bit can easily be removed through the drive-out opening and the through bore. On the other hand, in the event of damage the insert can also be removed through the drive-out opening.

The invention will be explained below in further detail with reference to an exemplifying embodiment depicted in the drawings, in which.

Figure 1:
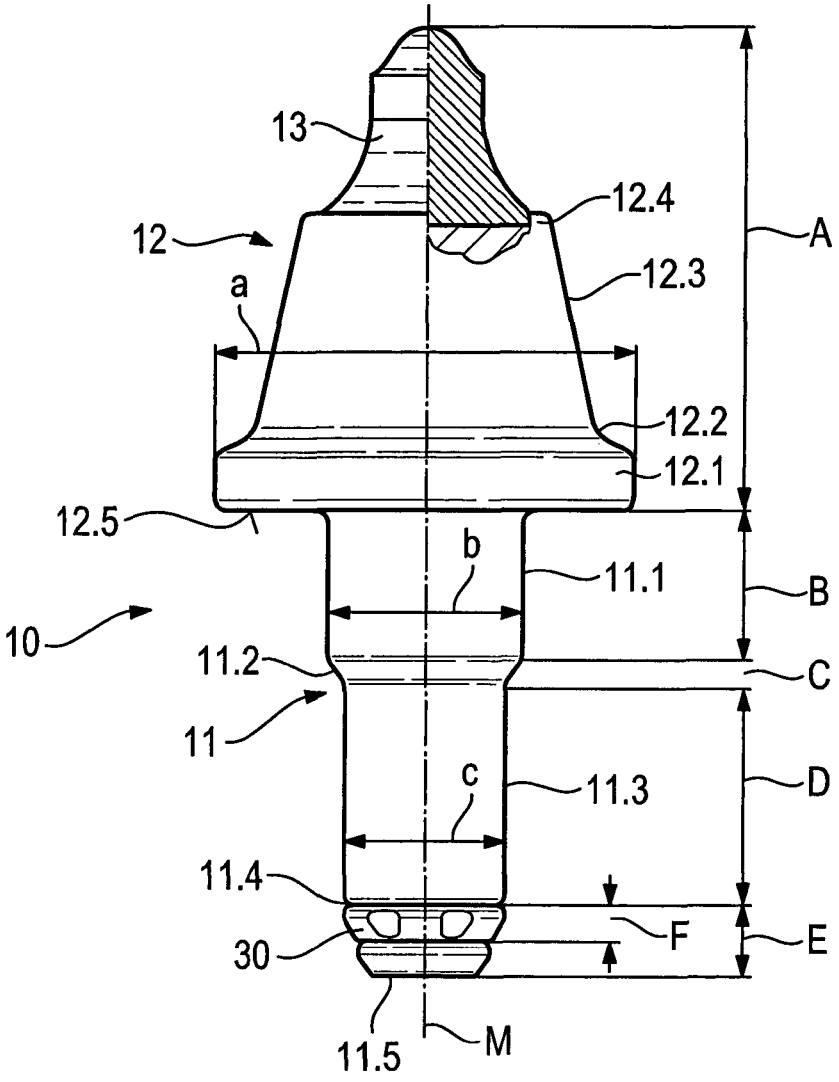
FIG. 1 is a side view and partial section of a shank bit.
Figure 3:
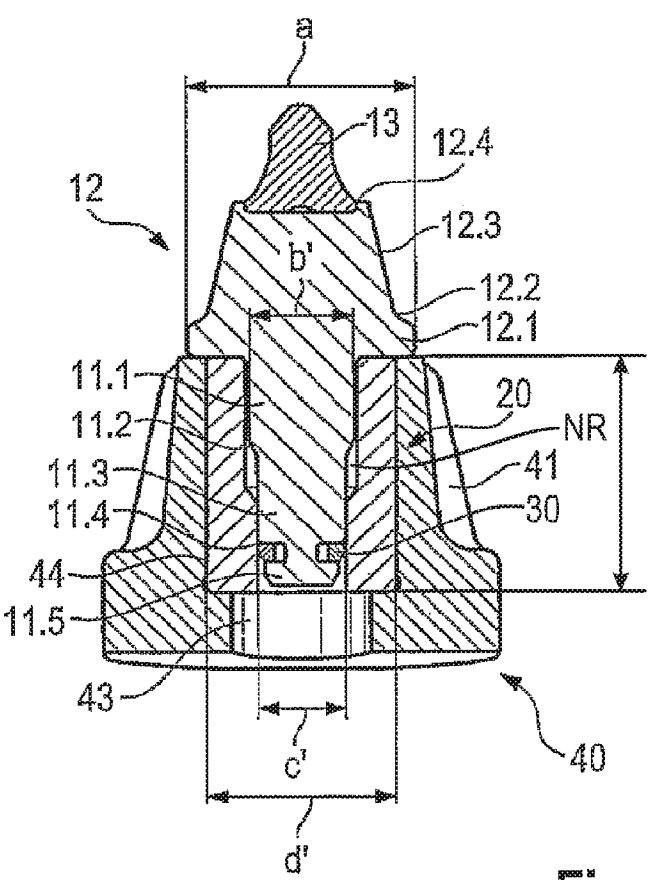
FIG. 3 is a vertical section showing a detail of the depiction of FIG. 2.
Figure 2:
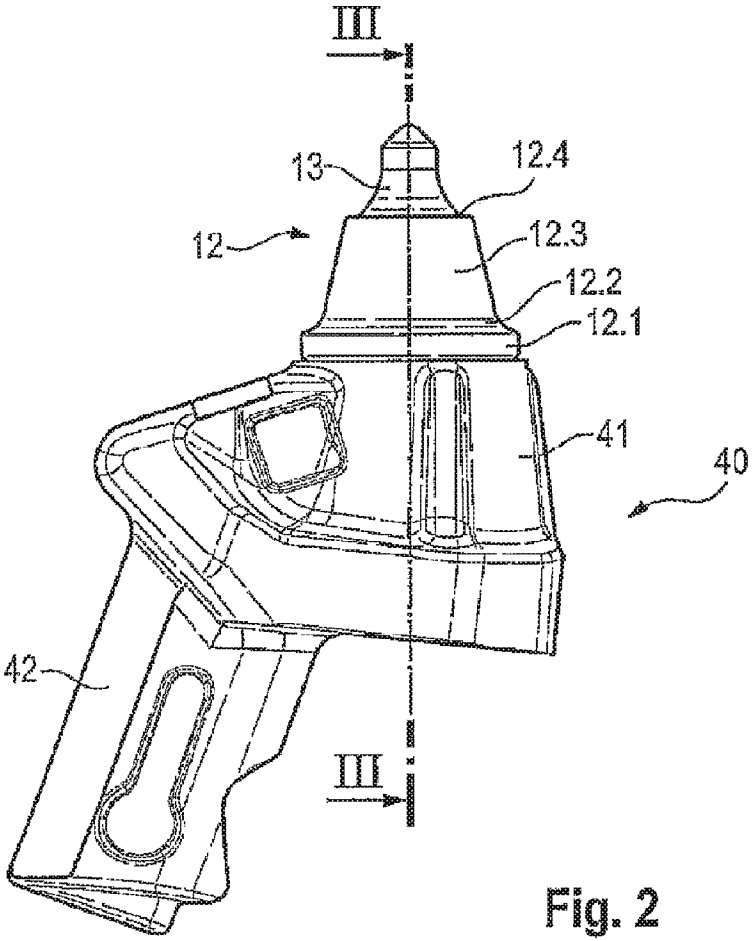
FIG. 2 is a side view showing a combination made up of a bit holder and the shank bit shown in FIG. 1.

FIG. 2 shows a bit holder 40 that is utilized to receive shank bit 10 according to FIG. 1. Bit holder 40 comprises a base part onto which a projection 41 and an insertion projection 42 are integrally shaped. As FIG. 3 shows, projection 41 is equipped with a cylindrical inner receptacle 44 into which an insert 20 made of hard material, in particular of hard metal, is inserted. Insert 20 is embodied in the form of a sleeve, and has a cylindrical outer geometry that is adapted to inside diameter d' of inner receptacle 44 in such a way that upon installation of insert 20 into bit holder 40, a press fit results (interference fit). The inserting motion of insert 20 into inner receptacle 44 is limited by a setback. The setback is embodied in the transitional region of inner receptacle 44 to a drive-out opening 43 embodied as a bore. Inner receptacle 44 and drive-out opening 43 are coaxial with one another. Insert 20 has a stepped bore that comprises a first diameter region 21 and a second diameter region 23. The two diameter regions 21, 23 are guided into one another via a taper 22. Taper 22 has a frustoconical geometry. As is evident from FIG. 3, inside diameter c' of the second diameter region is selected to be smaller than the inside diameter of drive-out opening 43. This results in a drive-out shoulder on insert 20. Insert 20 can thus be ejected as necessary from bit holder 40 by means of a tool introduced through drive-out opening 43 and set against the drive-out shoulder.

The component extents of shank bit 10 in the direction of longitudinal center axis M of shank bit 10 are noted in FIG. 1. Specifically, bit head 12, including cutting element 13, has a head length A that is in the range between 35 mm and 60 mm. First cylindrical segment 11.1 has an extent B in the direction of longitudinal center axis M of the bit shanks 30 mm. An extent of 15 mm is selected in the present case. The length of the transitional segment is labeled C, and should be <10 mm. An extent of approx. 3 mm is selected in the present case. The length of second cylindrical segment 11.3 is noted as D, and has an extent in the direction of longitudinal center axis M in the range between 10 and 40 mm. The length of terminal segment E, encompassing securing receptacle 11.4 and shoulder 11.5, should be a minimum of 3 mm. A dimension of 7 mm is selected in the present case, the groove width F of securing receptacle 11.4 being approx. 3 mm.

Dimensions are further provided in FIG. 1 for outside diameter a of support surface 12.5, diameter b of first cylindrical segment 11.1, and diameter c of second cylindrical segment 11.3. Diameter b of first cylindrical segments 11.1 is in the range between 18 mm and 30 mm. Diameter c of second cylindrical segment 11.3 is selected in the range between 14 mm and 25 mm. Outside diameter a of support surface 12.5 is in the present case between 30 mm and 46 mm, and is selected particularly preferably in the range between 40 mm and 44 mm.

FIG. 2 shows a bit holder 40 that is utilized to receive shank bit 10 according to FIG. 1. Bit holder 40 comprises a base part onto which a projection 41 and an insertion projection 42 are integrally shaped. As FIG. 3 shows, projection 41 is equipped with a cylindrical inner receptacle 44 into which an insert 20 made of hard material, in particular of hard metal, is inserted. Insert 40 is embodied in the form of a sleeve, and has a cylindrical outer geometry that is adapted to inside diameter d' of inner receptacle 44 in such a way that upon installation of insert 20 into bit holder 40, a press fit results (interference fit). The inserting motion of insert 20 into inner receptacle 44 is limited by a setback. The setback is embodied in the transitional region of inner receptacle 44 to a drive-out opening 43 embodied as a bore. Inner receptacle 44 and drive-out opening 43 are coaxial with one another. Insert 20 has a stepped bore that comprises a first diameter region 21 and a second diameter region 23. The two diameter regions 21, 23 are guided into one another via a taper 22. Taper 22 has a frustoconical geometry. As is evident from FIG. 3, inside diameter c' of the second diameter region is selected to be smaller than the inside diameter of drive-out opening 43. This results in a drive-out shoulder on insert 20. Insert 20 can thus be ejected as necessary from bit holder 40 by means of a tool introduced through drive-out opening 43 and set against the drive-out shoulder.

Figure 11:
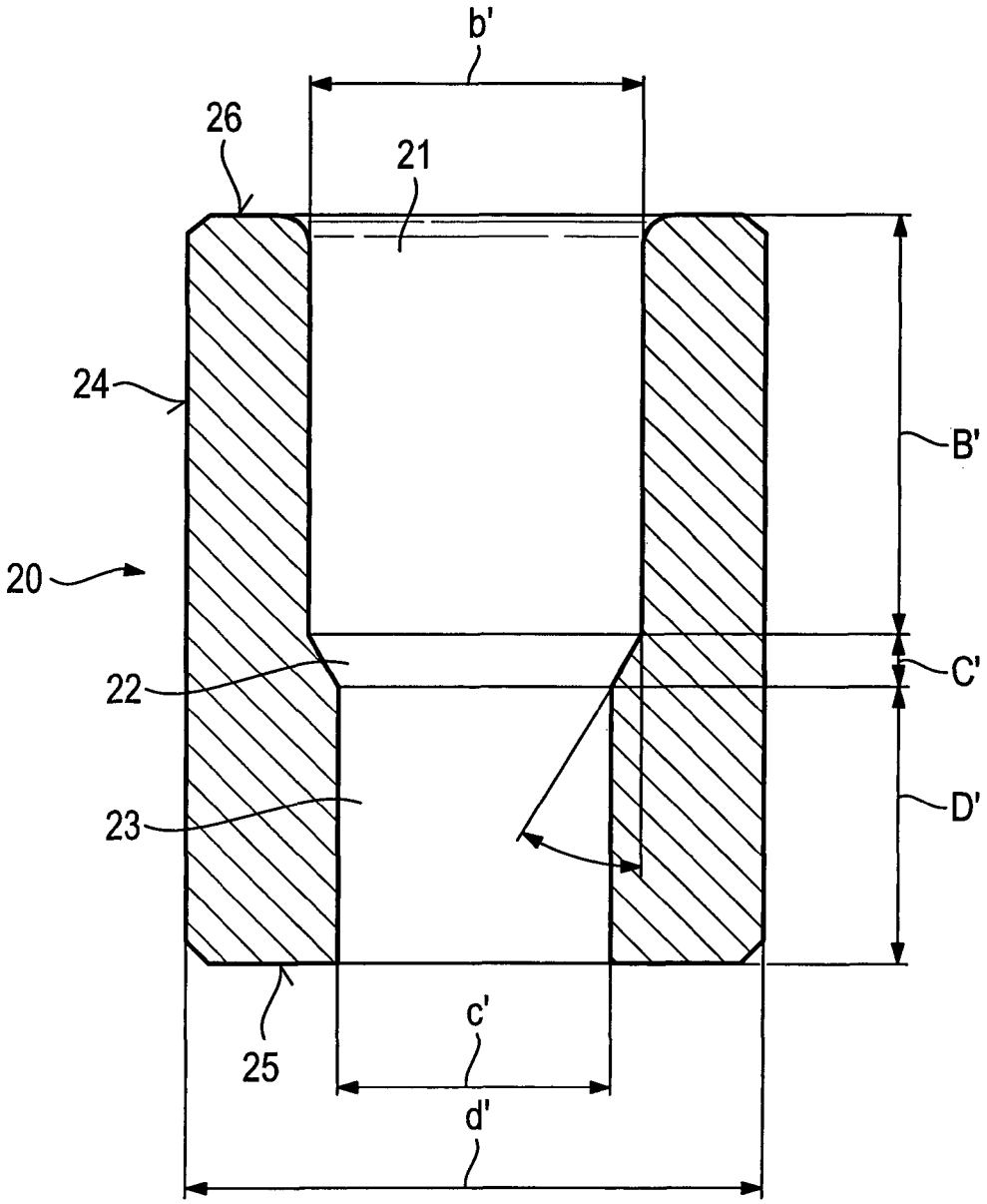
FIG. 11 is a side view and vertical section showing an insert for installation in the bit holder according to FIGS. 2 and 3.

The configuration of insert 20 is detailed further in FIG. 11. As this drawing shows, the external geometry of insert 20 is constituted by a fit surface 24 that, as described above, forms a snug fit with inner receptacle 44. Transversely to the longitudinal center axis of insert 20, insert 20 possesses a lower abutment surface 25 that, in the installed state, comes to a stop against a countersurface of inner receptacle 44, as shown in FIG. 3. An exact association of insert 20 with bit holder 40 is thereby enabled. Insert 20, facing away from abutment surface 25, abuts with an abutting surface 26 flush against an adjoining end face of bit holder 40, as likewise illustrated in FIG. 3. First diameter region 21 of insert 20 has a diameter b', and second diameter region 23 has a diameter c'. Diameters b' and c' are designed in a manner adapted to diameters b and c of the respective first and second cylindrical segments 11.1 and 11.3 of bit shank 22. The association of shank bit 10 with insert 20 is ensured here, with little clearance, in such a way that shank bit 10 remains freely rotatable around its longitudinal central axis M. The extent of first diameter region 21 in the direction of longitudinal central axis M is B'; as FIG. 3 clearly indicates, this extent B' is greater than the extent b of first cylindrical segment 11.1.

The extent of second diameter region 23 is labeled D' in FIG. 11, and the extent of taper region is labeled C'. Extent D' is selected so that bit shank 11 is received entirely within insert 20, as is apparent from FIG. 3.

Figure 4:
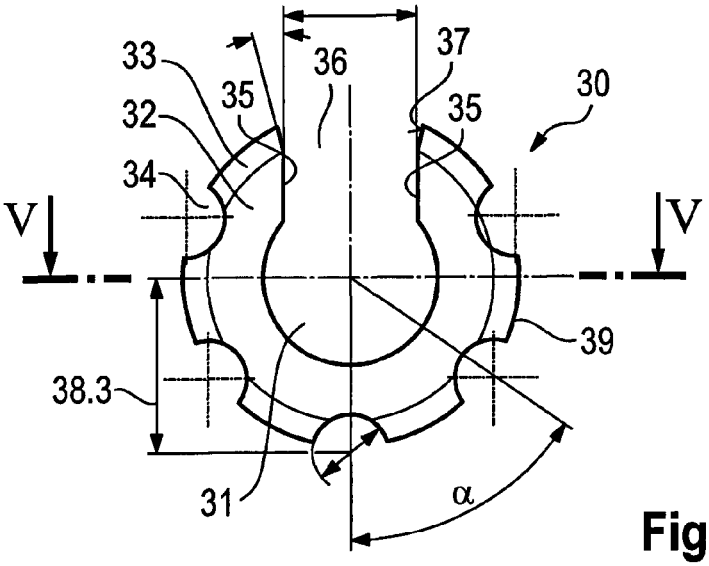
FIG. 4 is a plan view of a securing element.

As mentioned earlier, a securing receptacle 11.4 in the form of a circumferential groove is provided in the region of bit shank 11. A securing element 30 is received in this groove, as shown in further detail in FIGS. 4 to 6. As these drawings show, securing element 30 possesses a partially annular circumferential clamping part 32, radially externally adjacent to which are fastening segments 33, which in the present case are embodied in the form of a chamfer as cross-sectional reductions. The cross-sectional reductions are interrupted by recesses 34 which extend into clamping part 32. The result is to form prong-shaped radially external holding segments 39 in the form of curved regions spaced away from one another at an angle $\alpha$ preferably from 50° to 70°, in the present case 60°. These convex curved regions serve to clamp securing element 30 in place in second diameter region 23 of insert 20, as shown in FIG. 3. Clamping part 32 surrounds a bearing receptacle 31 that, together with the groove base of securing receptacle 11.4, forms a rotary bearing system. This bearing receptacle 31 opens into a slot that forms an introduction opening 36. Introduction opening 36 is demarcated by two rims 35 that open out into introduction chamfers 37. Introduction chamfers 37 are arranged so that they widen into introduction opening 36.

Figure 5:
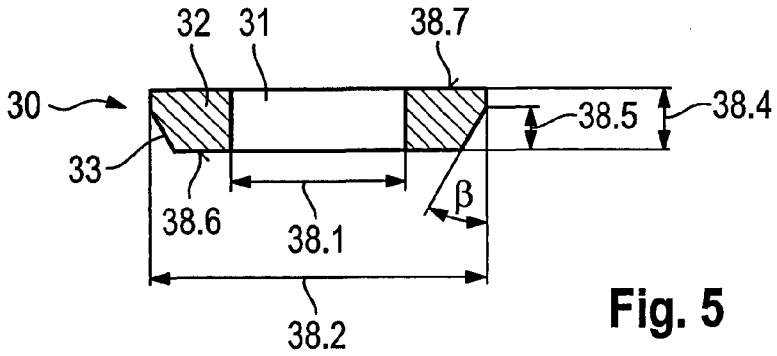
FIG. 5 is a side view, and a section V-V according to FIG. 4, showing the securing element according to FIG. 4.
Figure 6:
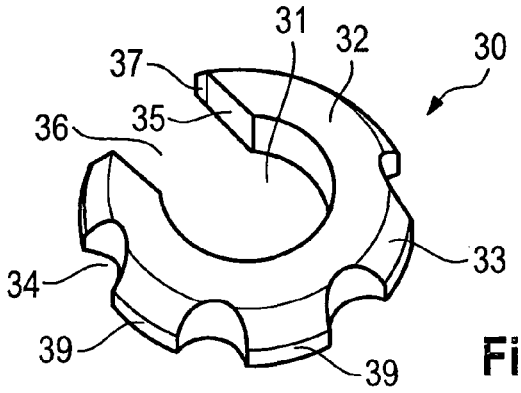
FIG. 6 is a perspective depiction of the securing element according to FIGS. 4 and 5.
Figure 7:
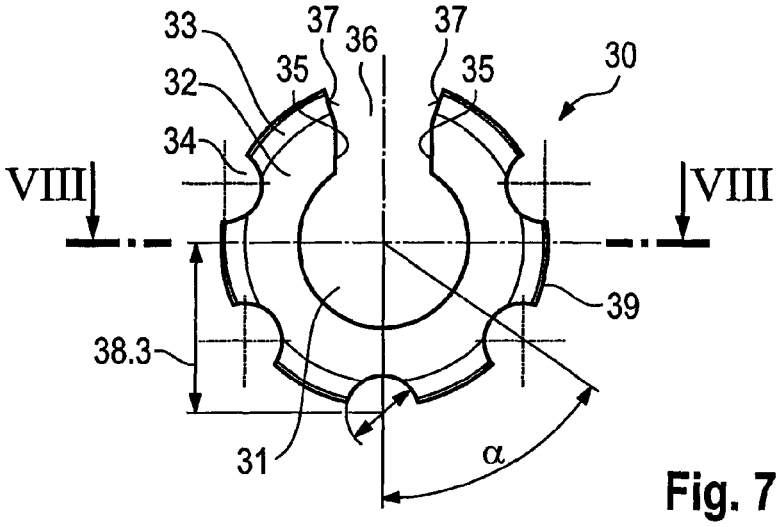
FIG. 7 is a plan view showing a further variant embodiment of a securing element.

As is evident from FIG. 5, bearing receptacle 31 has an inside diameter 38.1, and fastening segments 33 define an outside diameter 38.2. Securing element 30 has an overall height 38.4 that is less than the width of the groove-shaped securing receptacle 11.4. Fastening segments 33 extend over a segment height 38.5, and define an inclination angle β.

FIGS. 7 to 10 show a further variant configuration of a securing element 30. In these Figures, identical reference characters refer to corresponding elements already described with reference to FIGS. 4 to 6, and reference may be made to the previous statement in order to avoid repetition. Securing element 30 again comprises a bearing receptacle 31 that is radially accessible via an introduction opening 36. Introduction opening 36 is demarcated by a rim 35, and rim 35 leads into introduction chamfers 37. In contrast to the embodiment according to FIGS. 4 to 6, securing element 30 is produced in the form of a stamped and bent part in which no material-removing machining or similar reshaping work is necessary in order to constitute fastening segment 33 that is angled with respect to clamping part 32. Correspondingly, for production of securing element 30, firstly a disk-shaped cross section is stamped out, and that is then reshaped, in a bending step, into the configuration visible in FIG. 8.

Figure 8:
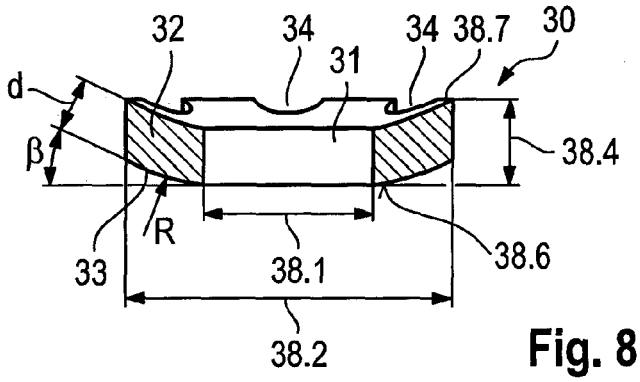
FIG. 8 shows the securing element according to FIG. 7 along the section marked VIII-VIII in FIG. 7.
Figure 9:
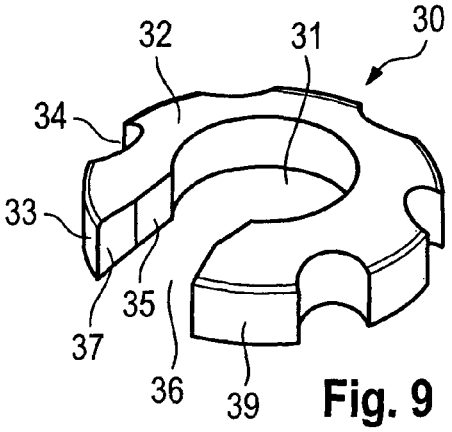
FIGS. 9 and 10 are perspective views of the securing element according to FIGS. 7 and 8.
Figure 10:
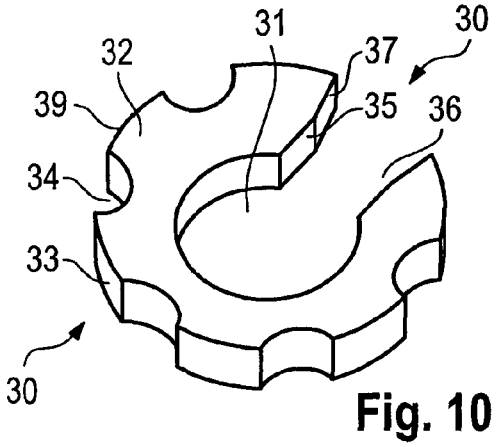

As is evident from FIG. 8, outside diameter 38.2 of securing element 30 is arranged concentrically with the wall (inside diameter 38.1) forming bearing receptacle 31. To achieve this concentricity, either the outer contour of securing element 30 can be reworked, or the stamping die can already be configured so that concentricity is achieved after the concluding bending step.

It is further evident from FIG. 8 that thickness d of securing element 30 is selected to be approximately the same both in the region of clamping part 32 and in the region of fastening segment 33. Fastening segment 33 forms on its underside a convex bulge having a radius R, thus resulting in a surface inclined with respect to the longitudinal center axis of securing element 30, which surface facilitates installation of securing element 30 in insert 20 of bit holder 40, as will be explained in further detail below.

Securing element 30 is concavely indented in the region of its upper side. This results in the formation of linear or narrow strip-shaped abutting regions 38.7 that serve for better rotational behavior of securing element 30 with respect to shank bit 10, as will be explained in further detail below. Recesses 34 are once again recessed in partially circular fashion into fastening segment 33, and extend into the region of clamping part 32.

For installation of securing element 30 on shank bit 10, the latter is firstly placed with introduction chamfers 37 on the groove base of securing receptacle 11.4. Bit shank 11 can then be slid into bearing receptacle 31 by means of a radial pressure, the rotary bearing system then being formed between the groove base of securing receptacle 11.4 and bearing receptacle 31. Securing element 30 expands radially upon insertion of bit shank 11, and once bit shank 11 has passed rims 35, securing element 30 snaps back into its original shape so that bit shank 11 latches into bearing receptacle 31. A lossproof connection of securing element 30 to shank bit 10 is thereby achieved. The unit made up of shank bit 10 and securing element 30 can then be slid into insert 20 of bit holder 40. For this, fastening segments 33 that face toward the free end of bit shank 11 are set onto taper 22. Because of the inclined embodiment of fastening segments 33, as shank bit 10 is slid in, securing element 30 becomes compressed radially inward and can thus be slid into second diameter region 23. Securing element 30 is thereby clamped against the inner wall of second diameter region 23. The deformation of securing element 30 is such that the free rotatability of bit shank 11 is maintained. Securing element 30 reliably braces with its holding segments 39 in second diameter region 23 in the region of fastening segments 33. The insertion motion of shank bit 10 into insert 20 is limited by support surface 12.5 of bit head 12. The latter comes to a stop against abutting surface 26 of insert 20, as shown in FIG. 3.

Shank bit 10 rotates in bearing receptacle 31 during operational use, and bit head 12 abrades with its support surface 12.5 against abutting surface 26 of insert 20. Because insert 20 is made of a hard material and bit head 12 is produced from a material that is softer relative thereto, only a small amount of wear occurs on bit holder 40. Shank bit 10, in contrast, is relatively more severely worn away in the region of its support surface 12.5. What results is a wear system in which the expensive bit holder 40 is worn away less than shank bit 10. A plurality of shank bits 10 can thus be used on one bit holder 40 before the latter reaches its wear limit.

Two wear effects occur, as indicated above, when shank bit 10 abrades away in the region of its support surface 12.5. On the one hand, the overall height of support segment 12.1 becomes reduced. On the other hand, abutting surface 26 of insert 20 is also worn away. As a result of these effects, bit shank 11 continuously recedes in the direction of its longitudinal center axis M into insert 20. First cylindrical segment 11.1 correspondingly slides along first diameter region 21, and securing element 30 along second diameter region 23. Free rotatability of shank bit 10 around its longitudinal center axis M is guaranteed by the use of a resetting space NR. This resetting space NR is shown in FIG. 3. It is created by the fact that the axial length of first cylindrical segment 11.1 is less than the axial longitudinal extent of first diameter region 21. In order to allow bit holder 40 having insert 20 to be utilized in wear-optimized fashion over its maximum possible service life, the axial extent of resetting space NR should be selected in the range between 4 mm and 20 mm.

With the geometrical relationships indicated, it is thus possible to go to the lower limit range of 4 mm when the substrate to be worked is fairly soft. Greater lengths for resetting space NR are better suited for hard ground. In road construction, where mixed concrete and asphalt need to be worked, a length of the resetting space from 7 mm to 20 mm has proven suitable.

In order to ensure secure retention of shank bit 10 over the entire service life of bit holder 40 in the context of the above-described wear system, second diameter region 23 of insert 20 is also dimensioned, in terms of its axial extent, so that securing element 30 can slide in an axial direction against the inner wall of second diameter region 23 in order to compensate for the longitudinal wear of insert 20 and of bit head 12. The axial length of the second diameter region must therefore be correspondingly adapted to the dimensions of resetting space NR. Applied to the dimensioning specifications above, second diameter region 23 must therefore have an axial length of at least 4 mm to 20 mm, plus twice a retention length for the securing element (position of securing element 30 in the unworn and worn state of bit holder 40). The retention length should be a minimum of 2 mm.

As is evident from FIG. 3, in the interest of a compact configuration the terminal shoulder 11.5 can be reset into the region of an opening segment that forms drive-out opening 43. The axial length of the opening segment is to be dimensioned accordingly.

During operational use, bit shank 11 slides with its first cylindrical segment 11.1 against the associated inner surface of first diameter region 21. Because, here as well, insert 20 is made of a hard material and bit shank 11 is made of a softer material, only a small amount of wear is caused here on insert 20 and thus on bit holder 40.

Securing element 30 as shown in FIGS. 7 to 10 is braced with its abutting regions 38.6 and 38.7, in linear or annular fashion with little radial extent, with respect to the groove walls of securing receptacle 11.4, so that good rotation behavior is achieved.

Once shank bit 10 is worn out, it can be removed. For this, a drive-out force is introduced by means of a suitable drive-out tool into the free end of bit shank 11 in the region of shoulder 11.5. Shank bit 10 with its securing element 30 then slides over second diameter region 23 until it springs back radially in the region of first diameter region 21. Shank bit 10 can then be freely removed.

Figure 12:
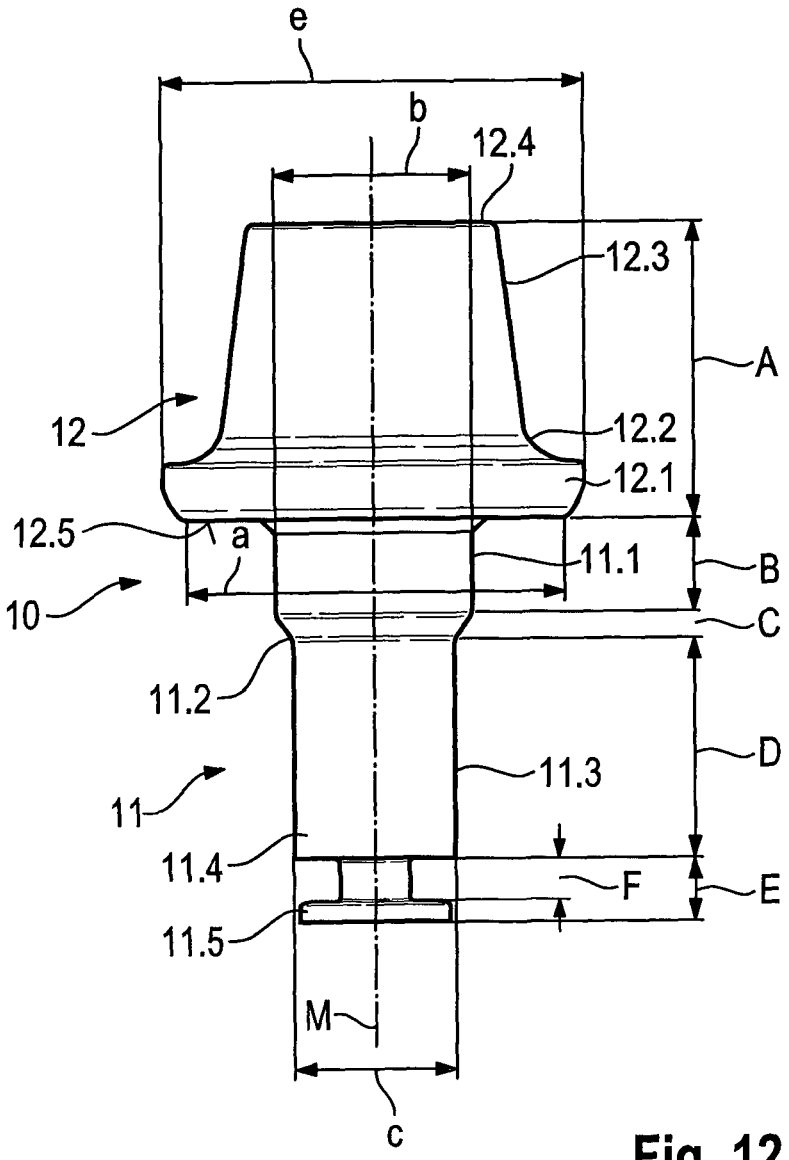
FIG. 12 is a side view of an alternative variant embodiment of a shank bit.
Figure 13:
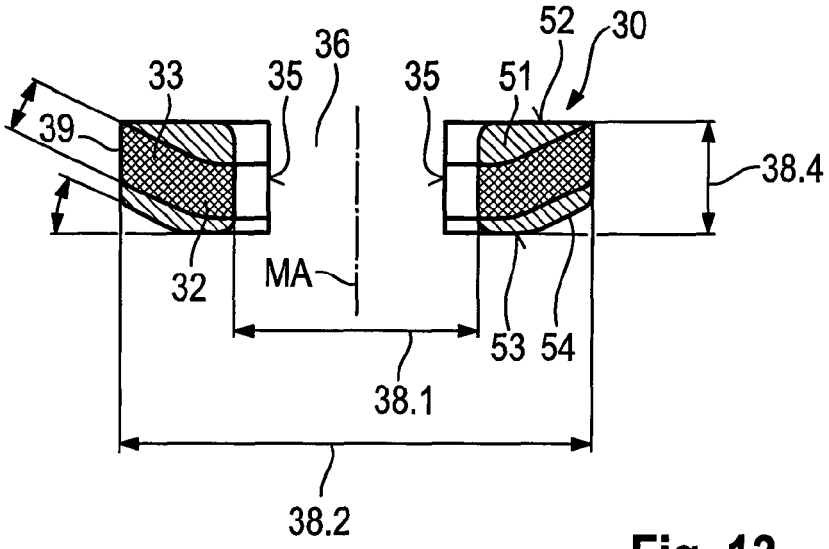
FIG. 13 shows a securing element for the shank bit according to FIG. 12, in a side view and in section along the section plane marked XIII-XIII in FIG. 14.
Figure 14:
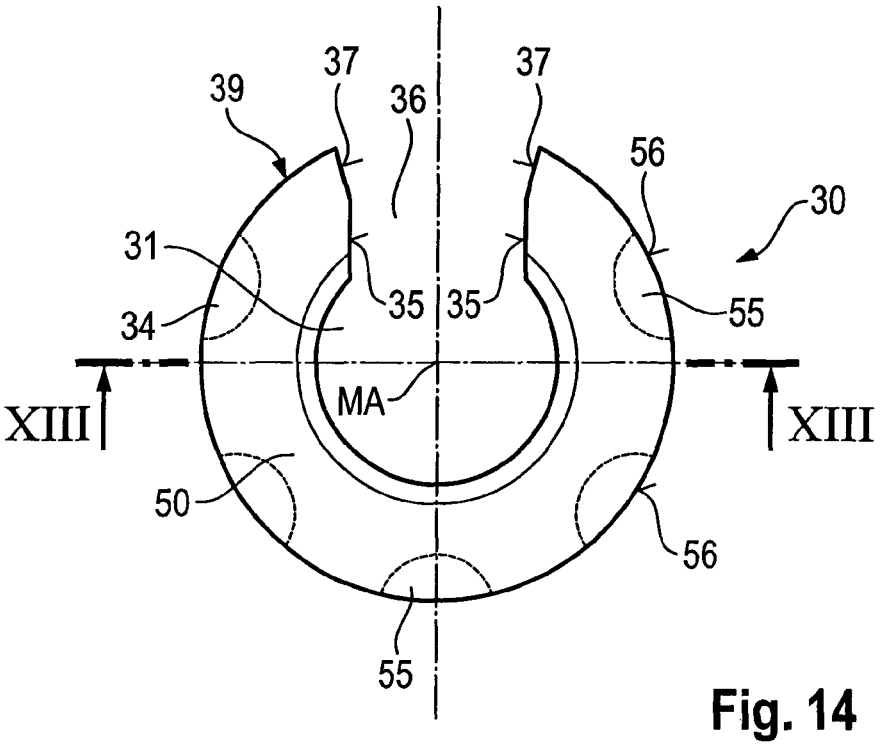
FIG. 14 is a plan view of the securing element according to FIG. 13.

FIGS. 12 to 14 show an alternative variant configuration of the invention. The configuration of shank bit 10 corresponds in terms of its general conformation to shank bit 10 according to FIG. 1. Shank bit 10 according to FIG. 12 can be installed, using securing ring 30 according to FIGS. 13 and 14, in insert 20 of bit holder 40 according to FIGS. 2, 3, and 11. In order to avoid repetition, those configuration features which differ will be discussed below; otherwise reference is made to the statements above.

Shank bit 10 having bit shank 11 and bit head 12 is once again produced as an extruded part or alternatively as a lathe-turned part.

Bit head 12 possesses support segment 12.1 having support surface 12.5. Support segment 12.1 leads via a convex radius transition into support surface 12.5. Support segment 12.1 possesses an outside diameter e in the range between 40 mm and 45 mm. Diameter a of support surface 12.5 is selected in the range between 36 mm and 42 mm. With these diameter relationships, i.e. more generally with a diameter ratio from 1 to 1.3 (diameter e/diameter a), considerable deformation is achieved in the region of support segment 12.1 upon cold extrusion. These material deformations result in a particularly tough composite material with good strength properties.

Bit head 12 once again comprises, adjacent to support segment 12.1, a concave taper 12.2 that leads into the frustoconical discharge surface 12.3. A cutting element receptacle 12.4 is formed at the end. A cutting element (13, see above) can be soldered into this.

Support surface 12.5 leads via a frustoconical transition segment into first cylindrical segment 11.1. The extent of first cylindrical segment 11.1 in the direction of longitudinal center axis M is selected to be appreciably shorter than in the exemplifying embodiment according to FIG. 1. Length B is 9 mm in the present case. This represents, with a diameter b of 19.8 mm, a sufficient dimension for road milling applications. With the shortened length of first cylindrical segment 11.1, the axial length of resetting space NR becomes greater. In the present case what results for road milling applications with mixed surfaces (asphalt and concrete) is a particularly suitable wear length of approx. 15 mm to 18 mm for resetting space NR.

Second cylindrical segment 11.3 has an extent D in the direction of longitudinal center axis M of 21.6 mm, and thus holds securing receptacle 11.4 at a spacing from support surface 12.5 sufficient for road milling applications. Diameter c of second cylindrical segment 11.3 is 16.5 mm.

Securing receptacle 11.4 is embodied with a width F of 4.5 mm, consequently somewhat wider than in FIG. 1 and coordinated with securing element 30 according to FIGS. 13 and 14.

The end-located shoulder 11.5 has a thickness of 3 mm and is thus sufficiently stable for road milling applications.

The conformation of securing element 30 will be discussed in further detail below with reference to FIGS. 13 and 14.

Securing element 30 comprises the stamped and bent part shown in FIGS. 7 to 10 as a basic member, with the difference that recesses 34 are not cut in as far as clamping part 32. Reference is made to the statements above regarding the features that are otherwise identical.

This base member is equipped on its surface with a layer 50 that has a lower hardness than the base member. In the present case layer 50 is made of a plastic material. In a particularly preferred application, layer 50 is made of a plastic material, from polyurethane or a composite material containing polyurethane. For reasons of production simplification and in order to create an intimate bond with the base member, layer 50 is molded onto the base member using the injection molding process.

Layer 50 comprises two coating regions 51 and 54. Coating regions 51, 54 are arranged respectively on the concavely curved upper and the convex undersides of the base member. In the region of recesses 34, coating regions 51, 54 are interconnected via connecting segment 55 in such a way that recesses 34 are completely filled up. The radially externally located curved regions of layer 50 thus transition flush into the convex curved regions of holding segments 39. Layer 50 can also project radially beyond holding segments 39.

Radially outer contact segments 56 are formed with the layer regions that fill up recesses 34. These segments abut internally against second diameter region 23 of insert 20. This produces here a friction surface pairing that introduces, in the direction of the longitudinal center axis, an additional frictional resistance that counteracts a pulling-out motion in that direction. The retention of shank bit 10 in insert 20 is thereby improved.

As is evident from FIG. 13, the radially externally located regions of holding segments 39 remain exposed, so that their function as described above is maintained. In addition, introduction chamfers 37 and rims 35 remain uncoated, so that the guidance function upon installation in cutting element receptacle 12.4 is maintained. Inside diameter 38.1 is furthermore also exposed and forms, with the groove base of securing receptacle 11.4, a wear-resistant and permanently accurately fitted rotary bearing system.

The two coating regions 51 and 54 respectively constitute bearing surfaces 52, 53 that proceed in the form of a partial ring around the longitudinal center axis of securing element 30. The two bearing surfaces 52, 53 extend radially and are parallel to one another. They serve for abutment against the groove walls of securing receptacle 11.4, in which context the axial clearance described above must be complied with. In order to achieve tilt-free operation, the axial clearance should be selected in the range between ≥0.2 mm and ≤4 mm. The two bearing surfaces 52, 53 complete the accurately fitted rotary bearing system. Layer 50 increases the stiffness, in particular the torsional strength of the base member, so that this stiff composite member reliably retains shank bit 10.

The invention claimed is:

1. A bit holder for a road milling machine or the like, comprising:

a base part including an insertion projection and a second projection, the second projection having an inner receptacle; and an insert received in the inner receptacle, the insert being made of a harder material than the base part, the insert having a bit receptacle defined therein, the bit receptacle including a stepped bore having a first diameter region and a second diameter region, the first diameter region having a larger inside diameter than the second diameter region;

wherein the insert has a longitudinal center axis, and the insert includes an axially outer abutting surface extending radially with respect to the longitudinal center axis, the axially outer abutting surface extending annularly around an entrance opening of the first diameter region;

wherein the second projection includes an annular axially outer surface surrounding the inner receptacle of the second projection, and the second projection defines a stop at an axially inner end of the inner receptacle; and wherein the insert includes an axially inner abutment surface received against the stop of the inner receptacle, such that the axially outer abutting surface of the insert is adjacent to and substantially flush with the annular axially outer surface of the second projection.

2. The bit holder of claim 1, wherein:

the first diameter region defines an insertion opening for a bit to be installed.

3. The bit holder of claim 1, wherein:

the first and second diameter regions lead into one another via a conical taper.

4. The bit holder of claim 1, wherein:

the inside diameter of the first diameter region is in a range of from 16 mm to 24 mm.

5. The bit holder of claim 1, wherein:

the inside diameter of the second diameter region is in a range of from 12 mm to 20 mm.

6. The bit holder of claim 1, wherein:

a diameter ratio between the inside diameter of the first diameter region and the inside diameter of the second diameter region is in a range of from 1.1 to 1.4.

7. The bit holder of claim 1, wherein:

the annular axially outer surface of the second projection extends radially with respect to the longitudinal center axis of the insert.

8. The bit holder of claim 1, wherein:

the second projection includes a bore segment forming a drive-out opening, the bore segment having a bore segment inside diameter; and the bit receptacle defines a through bore of the insert, the through bore opening into the bore segment of the second projection, the inside diameter of the second diameter region being smaller than the bore segment inside diameter.

* * * * *